US006887122B1

(12) United States Patent
Van Dan Elzen et al.

(10) Patent No.: US 6,887,122 B1
(45) Date of Patent: May 3, 2005

(54) YO-YO HAVING VISUAL INDICATION OF RESPONSE SETTING

(76) Inventors: Hans W. Van Dan Elzen, 1633 E. Lakeside Dr., #60, Gilbert, AZ (US) 85234; Benjamin J. McPhee, 8 Smith St., Hamilton (AU), 2303

( * ) Notice: Subject to any disclaimer, the term of this patent is extended or adjusted under 35 U.S.C. 154(b) by 0 days.

(21) Appl. No.: 10/903,451

(22) Filed: Jul. 29, 2004

(51) Int. Cl.[7] ..... A63H 1/30
(52) U.S. Cl. ..... 446/250; 446/236; 446/247
(58) Field of Search ..... 446/247–255, 446/236; 116/307, DIG. 1, 306, 309, 1, 200

(56) References Cited

U.S. PATENT DOCUMENTS 3,643,373 A * 2/1972 Russell ..... 446/245
5,184,972 A * 2/1993 Tomberlin ..... 446/250
5,356,328 A * 10/1994 Ho ..... 446/242
6,162,109 A * 12/2000 Baier ..... 446/250
6,331,132 B1 * 12/2001 Watson ..... 446/250
6,599,165 B1 7/2003 Van Dan Elzen

* cited by examiner

*Primary Examiner*—Derris H. Banks
*Assistant Examiner*—Urszula M Cegielnik
(74) *Attorney, Agent, or Firm*—Franklin L. Gubernick

(57) ABSTRACT

The invention is a yo-yo that features a visual indication system capable of facilitating the setting of the yo-yo's variable response system and then providing an indication to the user of the yo-yo's responsiveness setting. Preferably, the yo-yo includes relatively rotatable sides, with each side having a number of identical visual indicators and a number of tether engagement ribs that are in registry with the indicators.

20 Claims, 9 Drawing Sheets

YO-YO HAVING VISUAL INDICATION OF RESPONSE SETTING

FIELD OF THE INVENTION

The invention is in the field of user-manipulated toys. More particularly, the invention is an apparatus in the form of a yo-yo that provides an improved range of usability relative to the prior art. This is achieved through the use of an adjustable response system in combination with a visual indication system that allows the user to quickly set and readily determine the yo-yo's level of responsiveness.

BACKGROUND OF THE INVENTION

Most yo-yos are in the form of two disk-shaped side members that are connected to each other by some form of axle structure. The side members are typically made of plastic, metal or wood. The axle structure may be an assembly of multiple parts, or merely be in the form of a dowel or a riveted pin, and may be made of metal and/or wood and/or plastic. In many modern yo-yos, the axle structure includes a center-located bearing or other member that is secured to, and rotatable on, an elongated axle member.

The axle structure also forms an anchor for one end of a string-type tether. This is accomplished by having the tether's end-located loop encircle a portion of the axle structure.

The free end of the tether is usually tied to create a loop. This loop is normally placed about one of a user's fingers to thereby secure the yo-yo to the user. When the tether is wound about the axle structure and the yo-yo is released from the user's hand, the yo-yo will begin to rapidly spin as it moves away from the user's hand and the tether unwinds from the axle structure. Once the tether is fully unwound, the yo-yo may "sleep" at the end of the tether, whereby the yo-yo continues to spin without the tether rewinding on the axle structure.

There are three crucial performance characteristics of a yo-yo that enable a user to perform yo-yo tricks. The yo-yo must be capable of sleeping for an extended period of time, it should return on command, and it should be smooth on the tether.

Concerning a yo-yo's sleep time, the longer the yo-yo can be made to sleep, the more time the user will have to complete any particular yo-yo trick. It is well known that by minimizing friction in the yo-yo's components, one can maximize the yo-yo's sleep time.

For a yo-yo to return on command, the structure and design of the yo-yo must be such that when a user causes the tether to briefly go slack, a portion of the tether can snag a tether engagement member located on a spinning portion of the yo-yo. Tether engagement members, also herein referred to as engagement members, are any adaptations in the tether-facing surface of the yo-yo's side members designed to snag a portion of the yo-yo's tether. It should be noted that a tether-facing surface of a side member is herein defined as the surface of the side member that is normally oriented substantially perpendicular to the yo-yo's axis of rotation and that faces a portion of the yo-yo's tether at all times.

Concerning a yo-yo's ability to be smooth on the tether, this refers to a yo-yo's ability to be temporarily placed on a middle portion of the tether during a yo-yo trick and not have the tether inadvertently snag a spinning portion of the yo-yo. If the tether snags a spinning portion of the yo-yo at the wrong moment, the yo-yo will immediately return to the user's hand and the trick will be ruined.

The tendency of the tether to inadvertently snag on a spinning portion of the yo-yo is affected by a number of factors, including the size of the yo-yo's string gap and the aggressiveness of the yo-yo's tether engagement members. A yo-yo's string gap is herein defined as the open area between the yo-yo's two side members.

The width of the string gap is one of the most crucial elements in a yo-yo's design. The larger the width of the string gap proximate the axle structure, the further the tether has to travel before it can snag on a spinning portion of either of the yo-yo's side members. Too wide a string gap may preclude a user's ability to cause the tether to snag on a spinning portion of the yo-yo, with the result that a user cannot make the yo-yo return to his or her hand.

The aggressiveness of a yo-yo's tether engagement system is a measure of how readily the yo-yo's tether engagement members will snag a portion of the tether. While the tether engagement members facilitate the yo-yo's return on command, they are also usually responsible when the yo-yo inadvertently returns during a yo-yo trick. There is usually an inverse relation between the aggressiveness of the engagement system and a yo-yo's sleep time and smoothness on the string. Conversely, there is usually a direct relation between the aggressiveness of a yo-yo's engagement system and how easy it is for a user to get the yo-yo to return on command.

It has been a common practice in the yo-yo industry to provide different yo-yos for different types of users. A yo-yo designed for a beginner will often feature an aggressive tether engagement system, thereby favoring ease of return over all other performance characteristics of the yo-yo. It is thought that a beginning yo-yo player will have a more enjoyable experience if he or she can easily get the yo-yo to return on command. The player can then rapidly improve his or her skills with the yo-yo, until eventually the player may desire a yo-yo that is designed to favor other performance characteristics.

Higher performance yo-yos will often include adaptations that enhance sleep time and smoothness on the string. For example, while a ball bearing yo-yo can sometimes be harder to get to return than a fixed axle yo-yo, it will usually sleep longer on the end of a tether than most other yo-yos. Similarly, various tether engagement systems have been designed for the "pro" player and provide recessed or specially adapted engagement members that form a much less aggressive engagement system than the more common systems that employ a starburst shaped array of fixed engagement members that extend toward the yo-yo's tether.

Some modern yo-yos include an axle structure that enables a user to adjust the yo-yo's string gap. With these yo-yos, one can adjust the yo-yo to have a narrow string gap that facilitates a yo-yo's ability to return on command, or a wide string gap that favors a yo-yo's smoothness on the tether. However, with these yo-yos, there is no easy way to visually discern how a yo-yo will respond without actually trying the yo-yo. To adjust the yo-yo's responsiveness, a user will usually rotate one side member relative to the other by a small amount and then use the yo-yo once or twice to determine its responsiveness. This must often be repeated a number of times, requiring significant time and effort, before the yo-yo's responsiveness will be acceptable to the user. Furthermore, it often requires significant loosening of the yo-yo, up to two full turns of one of the yo-yo's side members, to go from a yo-yo condition in which return on command is favored, to a condition where the yo-yo is smooth on the string.

SUMMARY OF THE INVENTION

The invention is an improved yo-yo that features an adjustable response system and an associated visual indication system. The visual indication system functions to provide a user with a visual means to ascertain the responsiveness setting of the yo-yo and also functions to facilitate adjustment of the yo-yo's responsiveness. This enables easy adjustment of the yo-yo as well as its ability to be used for all types of yo-yo tricks and by players of all skill levels.

To enable adjustment of the yo-yo's responsiveness, each of the yo-yo's side members preferably features a tether engagement system that includes an array of spaced-apart tether engagement members. The method of adjusting the yo-yo's responsiveness involves a limited rotation of one of the yo-yo's side members relative to the other of the yo-yo's side members. When the engagement members of both of the yo-yo's side members are in direct registry wherein one side member's engagement members face the engagement members of the other side member, the yo-yo's tether engagement system is in an aggressive, responsive mode. In such a condition, it is easy to make the yo-yo return on command. If instead, the side members are positioned whereby the engagement members are offset whereby they are no longer in registry, the yo-yo's tether engagement system will be in a less aggressive mode whereby it will be slightly harder to get the yo-yo to return to the user's hand. In the latter condition, an experienced player can still easily get the yo-yo to return, but the yo-yo will have much less of a tendency for an inadvertent return. This setting makes the yo-yo more forgiving when the user is performing difficult string tricks. In the preferred embodiment, the system for adjusting the yo-yo's responsiveness is combined with an adjustable string gap system in order to extend the range of the yo-yo's responsiveness.

To make an adjustable response system readily usable, one must couple it with a system whereby a user can easily and quickly discern the relative positions of the engagement members of both of the yo-yo's side members. The visual indication system of the invention performs this function. Two different embodiments of a visual indication system are herein described.

The first embodiment of a visual indication system makes use of a clear plastic material for each of a yo-yo's two identical and relatively rotatable side members. The clear material enables a user to see gaps in a colored plastic ring located within an interior area of each of the side members. Each ring is directly connected to the associated side member's engagement members whereby the ring's gaps are in permanent registry with the engagement members. A user can simply look at the yo-yo to determine its responsiveness setting. If the gaps in the ring of one side member are in alignment with the gaps in the ring of the other side member, the user knows that the engagement members of the two side members are located directly opposite each other. In this position, the ability of a user to get the yo-yo to return on command is maximized. If the gaps are offset from each other, the user knows that the engagement members of one side member are offset from those of the other side member and the yo-yo's ability to return on command will be reduced, but the yo-yo will be smoother on the tether. The user can easily change from one performance setting to the other by a slight rotation of one of the yo-yo's side members relative to the other and noting the position of the gaps.

The second embodiment of a visual indication system is in the form of a plurality of easily visible thru-holes located in each of the yo-yo's two identical side members. In this embodiment, the engagement members are fabricated as an integral part of each side member so that the positions of the thru-holes are directly related to the positions of the engagement members. When said thru-holes in one side member are in registry with the thru-holes in the other side member, the tether engagement system is in a more aggressive mode whereby the engagement members of the two side members directly face each other. When the thru-holes in one side member are offset from those of the other, the tether engagement system is in a less aggressive mode. In this embodiment, when the thru-holes are in registry, one can look entirely through the yo-yo by looking through the thru-holes.

A yo-yo in accordance with the invention can be easily set to match the experience level of the user and/or to facilitate the performance of particular yo-yo tricks. All that is required for a user to change the yo-yo's performance characteristics is to slightly: rotate one side member relative to the other to thereby change the aggressiveness of the yo-yo's tether engagement system. In this manner, a user does not have to buy a new yo-yo once his or her skills improve, or have to perform a trial and error process to set the yo-yo's responsiveness. In addition, only a very minor relative rotation between the two side members of the yo-yo is required to cause a significant change in the aggressiveness of the yo-yo's tether engagement system.

DETAILED DESCRIPTION OF THE DRAWINGS

Figure 1:
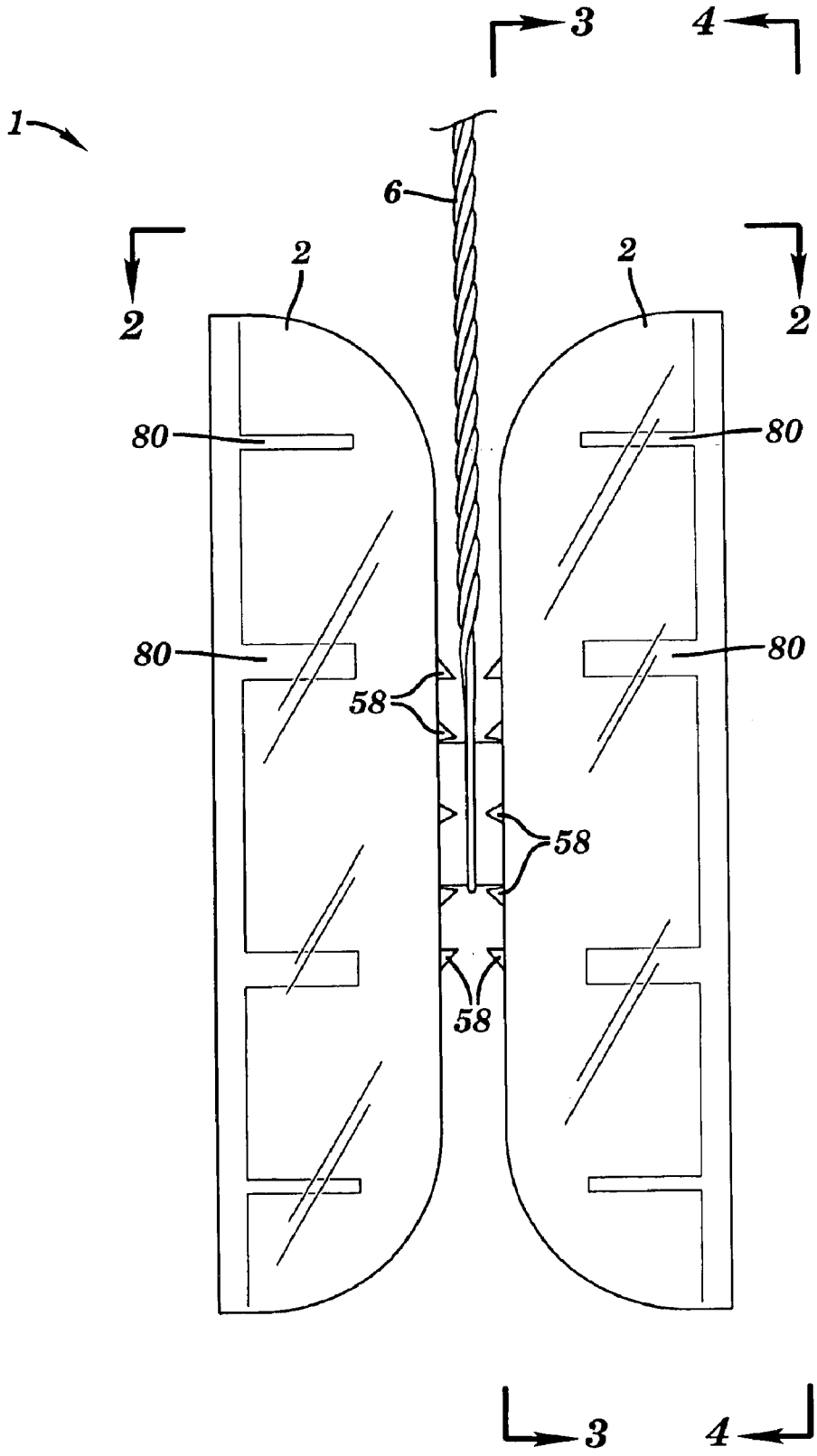
FIG. 1 is a front view of a first embodiment of a yo-yo in accordance with the invention.

Referring now to the drawings in greater detail, wherein like characters refer to like parts throughout the several figures, there is shown by the numeral 1 a yo-yo in accordance with a first embodiment of the invention.

The yo-yo 1 includes first and second identical disk-shaped side members 2 that are connected together via an axle structure 4. A string-type tether 6 includes a loop portion 8 that encircles a center portion of the axle structure. The tether's distal end (not shown) will normally be tied to create a loop to enable a temporary securement of said end to one of a user's fingers.

Each side member 2 includes an annular rim portion 12 that is attached to, and encircles, a hub portion 14. The center of the hub portion includes a thru-bore 16 through which a portion of the axle structure extends. Preferably in this embodiment, each side member is made of a rigid, transparent plastic material. Alternatively, the side members can be made of other materials, either rigid or non-rigid, or be a composite or assemblage of rigid and/or non-rigid parts that include at least a portion through which an inner portion or contained member of the side member is visible.

The axle structure 4 is preferably an assemblage of parts that includes an axle pin 20, a nut 22, two spacers 24 and a ball bearing unit 26. The axle pin is preferably in the form of a hex head bolt in which the head 30 is non-rotatably secured within a hexagonally-shaped complementary cavity 32 formed in the hub 14 of the left hand side member 2. The right-hand side member 2 preferably also includes a hexagonally-shaped cavity 32 into which is snugly, and non-rotatably, received the hexagonally-shaped nut 22. The nut 22 is preferably a locknut that is threadedly engaged to a threaded portion of the pin 20 to thereby secure the two side members 2 together. If one desires to disassemble the yo-yo, the nut 22 can be unscrewed from the pin 20 by rotation of either of the yo-yo's side members 2 relative to the other. It should be noted that other conventional types of connectors, such as a dowel, rivet, or a rod threaded at both ends, may be used in place of the above-described nut and bolt.

The ball bearing unit 26 is preferably conventional in design and comprises an inner race 36, an outer race 40 and a plurality of ball bearings 42 located therebetween. The axle pin 20 passes through the center of the ball bearing unit when the yo-yo is in an assembled condition. It should be noted that other types of rotatable units, including transaxles, can replace the ball bearing unit. Alternatively, the ball bearing unit can be dispensed with when the yo-yo employs a fixed-axle that does not employ any center-located relatively movable parts.

Each spacer 24 includes a thru-hole through which the axle pin 20 passes. When the yo-yo is assembled, an o-ring 44 is placed adjacent each spacer, and both are received within identical cavities 52 in their respective side members 2. The cavities 52 are preferably complementary in size and shape to the outer-facing surfaces of the spacers. Once in place, the spacer's inner-facing surface 54 contacts the bearing's inner race 36, but does not contact the bearing's outer race 40. It should be noted that the surface of the outer race is substantially perpendicular to the tether-facing surface 56 of each side member and does not contact either of the side members. Since the bearing's outer race does not contact the spacers or the side members, it is free to spin and can therefore move independently of the side members. The o-rings 44 are compressible and function to enable secure adjustment of the yo-yo's string gap. When the yo-yo is in an assembled condition, the o-rings allow a user to rotate one of the yo-yo's side members relative to the other side member for up to approximately two full revolutions while maintaining the assembled integrity of the yo-yo.

To facilitate the return of the yo-yo, each side member is shown having an active starburst tether engagement system. The system includes a plurality of tether engagement members in the form of movable tether engagement ribs 58. As can be seen in the figures, the ribs protrude into the yo-yo's string gap and function as the yo-yo's tether engagement members. A tether engagement rib may be interchangeably referred to herein as a tether engagement member.

Figure 3:
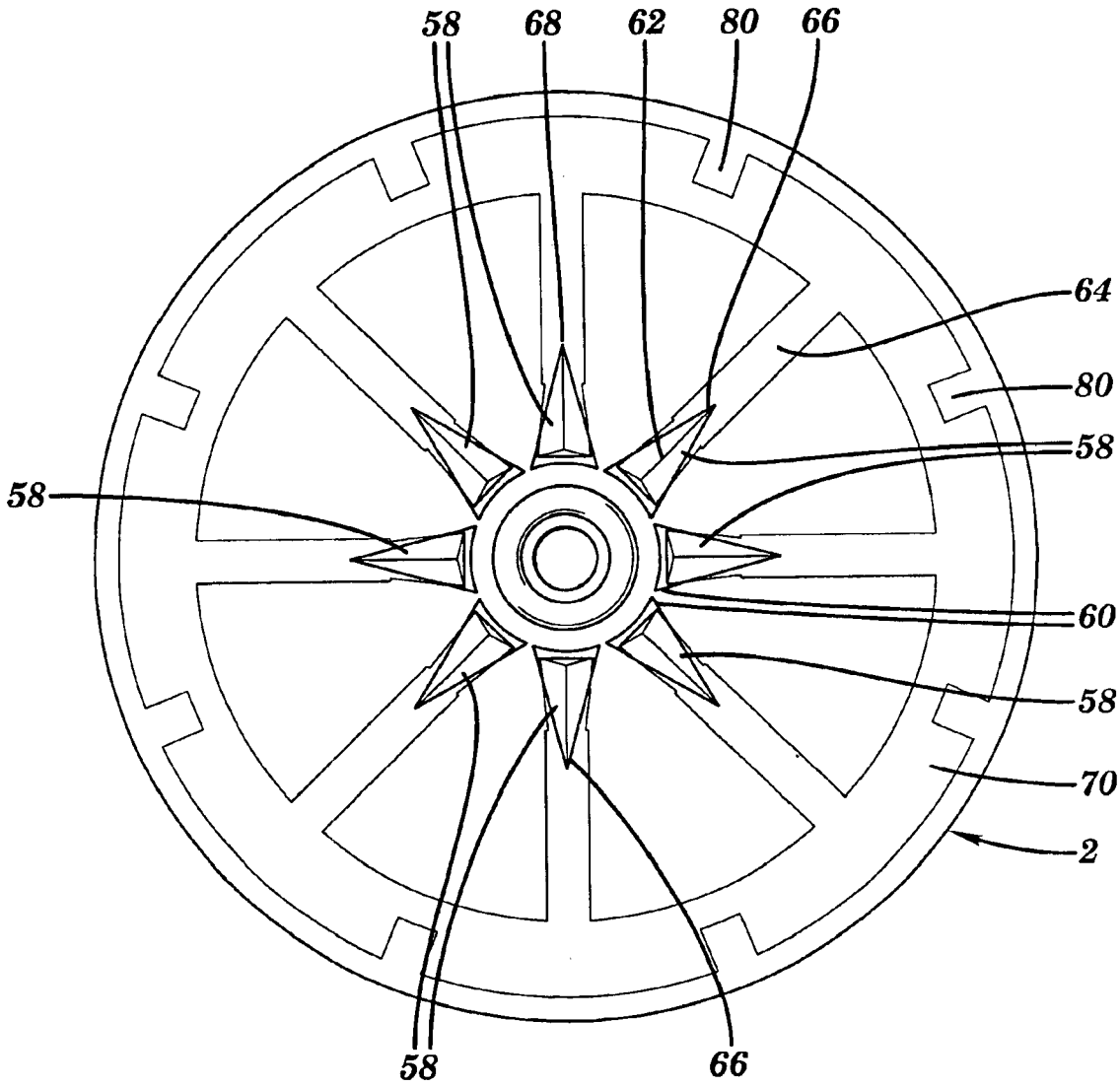
FIG. 3 is an elevation view of the tether-facing surface of one of the side members of the yo-yo shown in FIG. 1, taken at the plane labeled 3—3 in FIG. 1.
Figure 4:
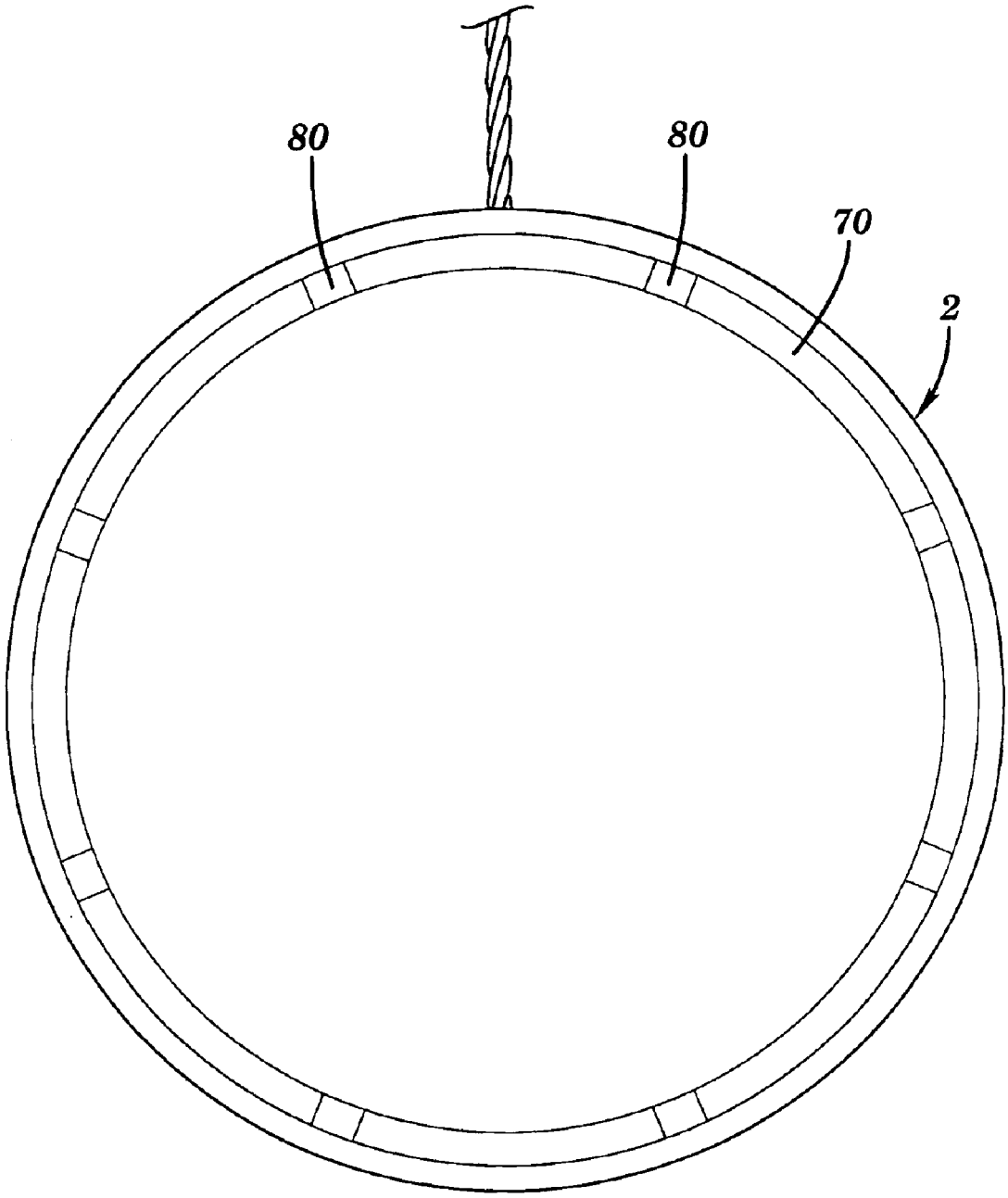
FIG. 4 is a side view of the yo-yo shown in FIG. 1, taken at the plane labeled 4—4 in said figure.

In FIG. 3, one can see that the ribs 58 are oriented in a starburst-shaped array about the center of the side member and extend through complementary apertures 60 in the associated side member's tether-facing surface. The tether-facing surface of the other side member is identical to that shown. As can be seen in the figure, each rib 58 is preferably somewhat triangular in shape and preferably includes a linear edge 62 to facilitate engagement with the tether. Since the apertures 60 are complementary in size and shape to the ribs, they are also triangular in shape. Side-to-side movement of the ribs is prevented by having the dimensions of the apertures only minimally greater than those of the ribs.

Each rib is secured to, and forms the end of, an elongated finger member 64. The finger members are preferably made of a material that provides some inherent flexibility, such as plastic or thin metal. The elongated shape of each finger member is preferably also partially responsible for the finger member's flexibility. It should be noted that the finger members are visible in FIG. 3 since the side members are made of a transparent material.

When each rib 58 is inserted through its associated aperture 60 in the side member, area 66 of the rib will preferably contact the aperture's apex 68. In this manner, the rib 58 is limited in the extent to which it can protrude into the yo-yo's string gap. This contact may cause the flexible finger member 64 to become slightly flexed in a direction away from the tether, thereby applying a pre-load on the finger member.

All of the flexible finger members 64 of a side member are attached to a common support ring 70. The support ring is preferably made of a substantially rigid, colored material, preferably a plastic or metal material, and includes an outer flange portion 72 that is received within a complementary groove 74 in the side member's rim portion 12. This engagement between flange portion 72 and groove 74 firmly secures the support ring to the side member. An outer lens 76, advertising pog 77 and metal weight ring 78 are also removably secured to the yo-yo via an engagement with the support ring.

The support ring 70 includes a plurality of elongated slots in the form of gaps 80. These gaps serve two functions. Firstly, they facilitate the ring's removal from, or insertion into, a yo-yo's side member by enabling a slight amount of dimensional flexibility in the support ring. Secondly, since each side member is made of a transparent material, or has at least a portion through which one can see an interior area of the member, a user can at all times see one or more of said gaps. Since the gaps are located in the same structure to which the ribs are secured, the gaps are in permanent registry with the ribs and provide a user with a visual indication of the relative locations of said ribs.

The visual indication system is based on the idea that if a user can see at least one of gaps 80 in each of the side members at the same time, said user can affect the responsiveness of the yo-yo by rotating the side members relative to each other to align or misalign the gaps. This is made possible by having the same registry between the gaps and the ribs in both side members. When one aligns any gap 80 in one side member with any gap 80 in the other side member, one causes the ribs in both side members to be aligned whereby the ribs of the two side members face each other. When the ribs of the two side members are aligned, the tether engagement system is at its most aggressive for the particular string gap. If one instead positions the gaps in the two side members in a non-aligned manner, the ribs will be offset whereby the yo-yo's tether engagement system will be less aggressive for the particular string gap.

Figure 2:
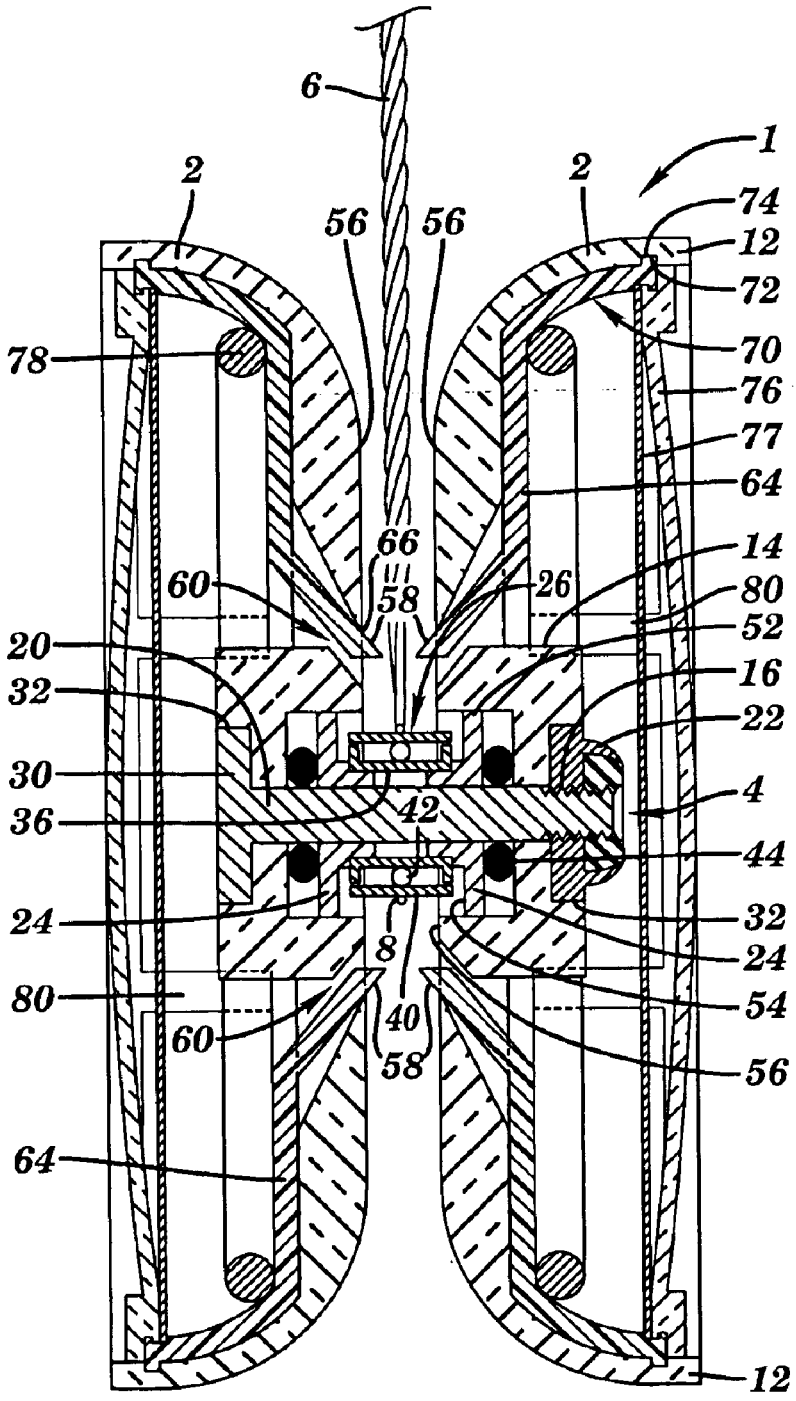
FIG. 2 is a cross-sectional view of the yo-yo shown in FIG. 1, taken at the plane labeled 2—2 in FIG. 1.
Figure 5:
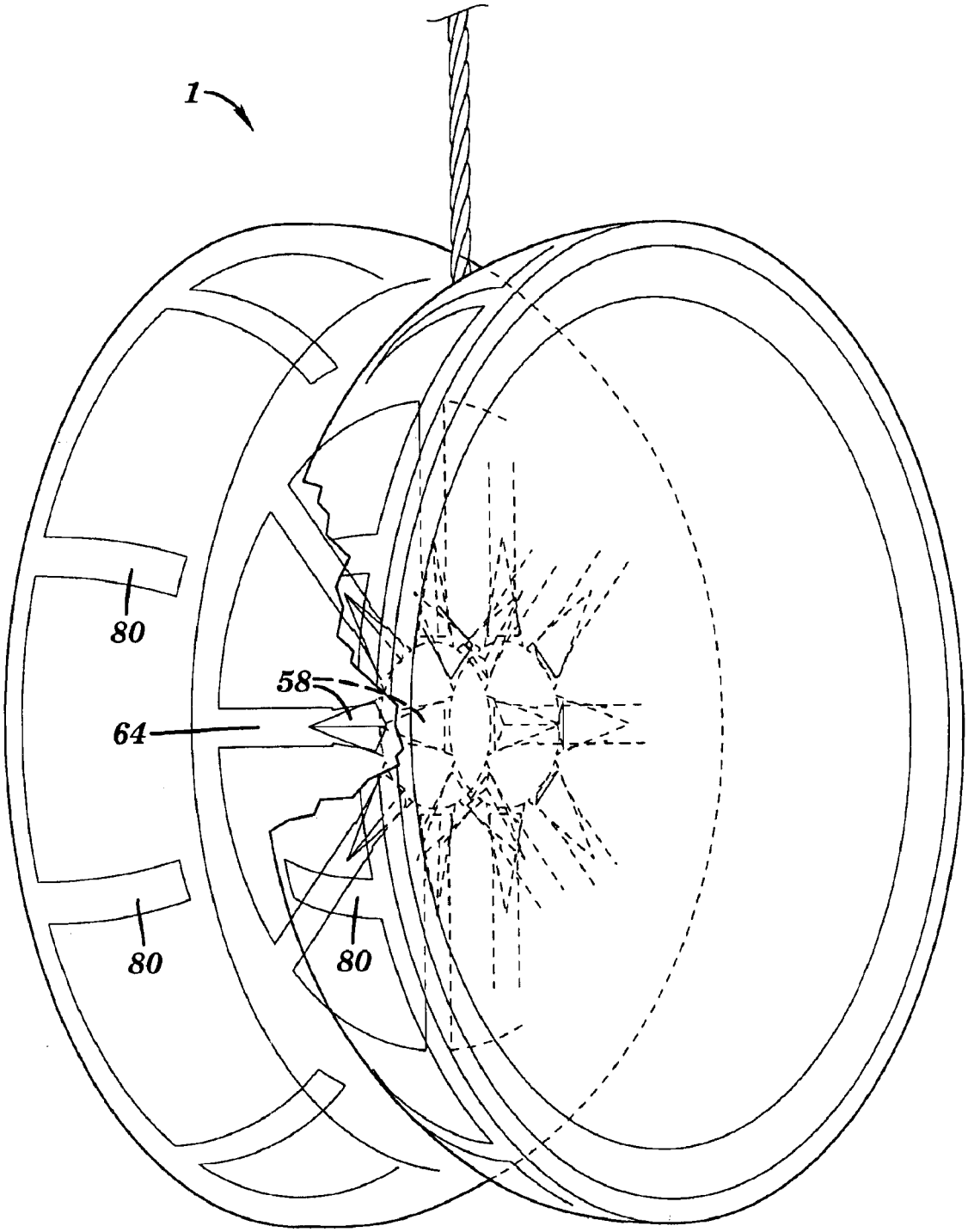
FIG. 5 is a perspective view, with a portion cut-away, of a generalized version of the yo-yo shown in FIG. 1.

In FIGS. 1, 2 and 5, the yo-yo is shown at the end of the tether, with the tether at a central location where it is spaced from all of the ribs 58. Also in the figures, it should be noted that the ribs 58 are located wherein the ribs of one side member are located directly opposite those of the other side member. This aligned condition is also exhibited by the gaps 80, wherein the visible gaps of one side member are located directly across from those of the other side member.

FIG. 5 shows a perspective view of a generalized version of the yo-yo shown in FIG. 1. Some portions are not shown and a portion is cut-away to enable one to easily see that the ribs 58 of the two side members face each other when the gaps 80 of the two side member are in alignment.

To understand how changing the alignment of the tether engagement members affects how the yo-yo will return, it is important to understand how the tether is made. To create a conventional yo-yo tether, a long flexible string, preferably made of cotton, is folded in half and the two halves/strands of the string are twisted together in a helical configuration. When the yo-yo is sleeping at the end of the tether, the weight of the yo-yo puts a strain on the tether, thereby causing the strands to remain tightly twisted together.

To get the yo-yo to return, a user moves his or her hand to cause a single jerk/tug on the tether. In response, the yo-yo will move toward the user's hand. As the yo-yo moves toward the user's hand, the user's hand moves toward the yo-yo. This results in a temporary slackening of tether whereby the lack of tension in the tether allows the tether's strands to slightly unwind in the area near the yo-yo's axle structure. The untwisting strands move outwardly toward one or both of the side members, whereupon one or both of the strands will snag on at least one of the engagement ribs 58. It should be noted that when the tether is in a slackened condition, the portions of the strands that, have moved outwardly are extremely flexible and air currents generated within the spinning yo-yo can affect the movement of the strands. Once a strand becomes snagged on a rib 58, the tether becomes effectively locked onto the spinning side member(s) and as a result, winds about the yo-yo's axle structure. As the tether winds about the axle structure, the yo-yo returns to the user's hand.

When the engagement members of the yo-yo's two side members are in direct registry and face/directly oppose each other, the distance between opposing ribs is minimized and can be measured in a direction parallel to the yo-yo's axis. Minimizing the separation distance acts in the same manner as minimizing the string gap. A small string gap provides little room for a slackened tether to move before it is snagged by an engagement member. In addition, when the ribs 58 are in registry, they work in tandem, each pair working like a vane in a pump, to move the air within the string gap to thereby theoretically create turbulence that favors an outward movement of the tether's strands. These factors effectively act to increase the aggressiveness of the yo-yo's tether engagement system.

Figure 6:
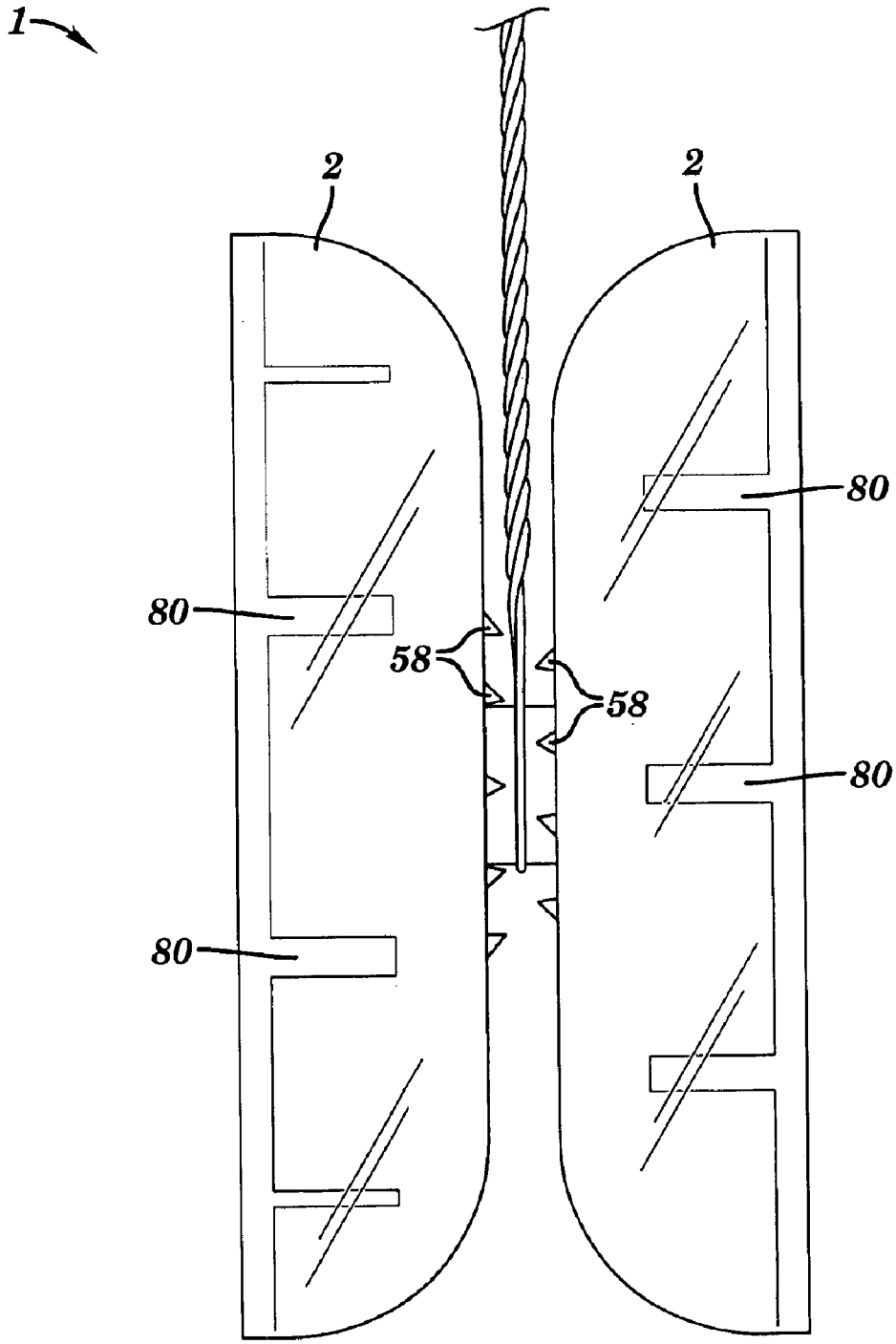
FIG. 6 is a front view of the yo-yo shown in FIG. 1 after one of the yo-yo's side members has been slightly rotated relative to the other of the yo-yo's side members.

FIG. 6 shows the same yo-yo as shown in FIG. 1. However, in this figure, the yo-yo is shown in a condition wherein one of the side members has been slightly rotated relative to the other side member so that the visible gaps 80 of the two side members are offset/non-aligned. Placing the gaps in an offset condition causes the ribs 58 of the two side members to be offset whereby they are no longer located in direct opposition to each other.

Figure 7:
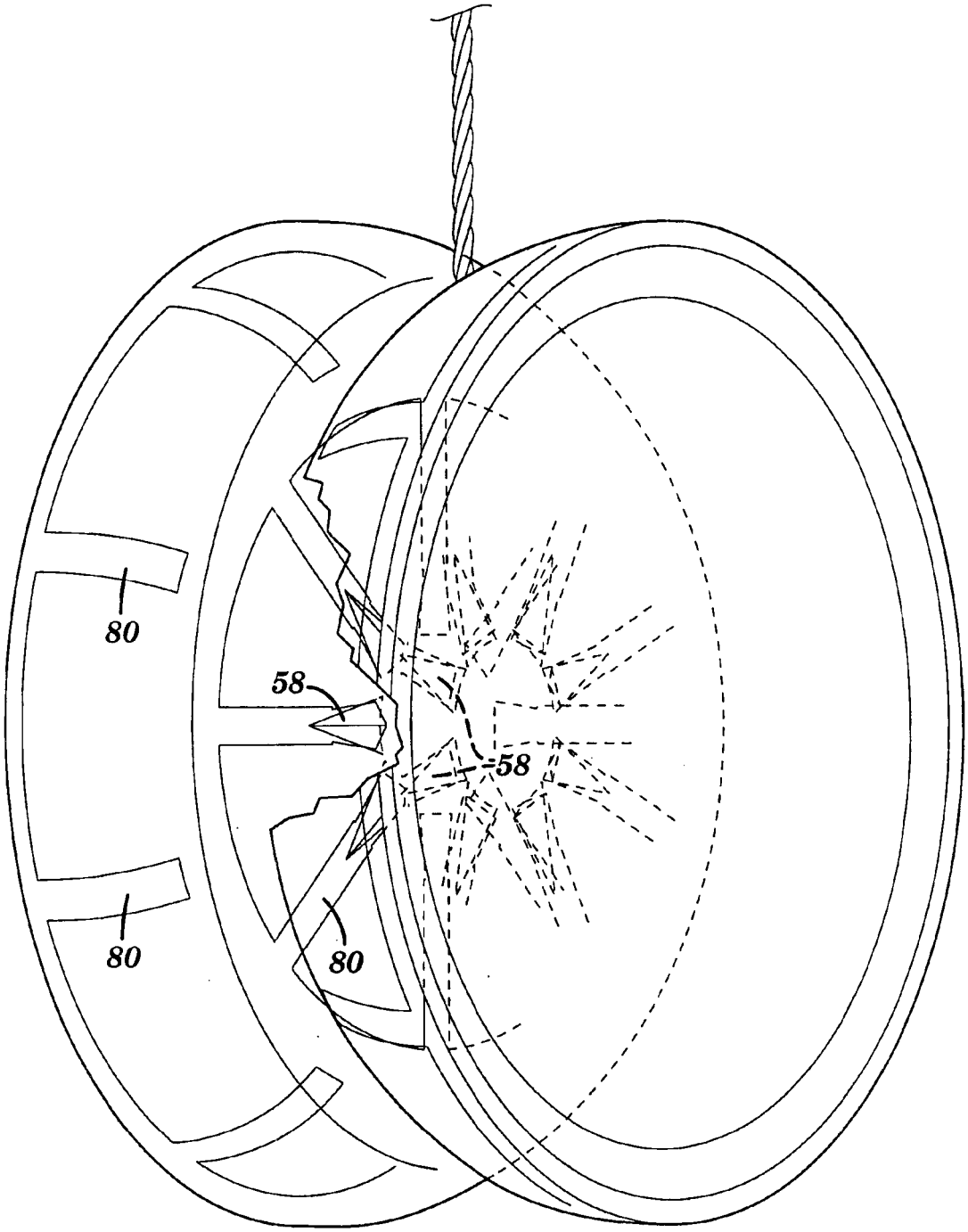
FIG. 7 is a perspective view, with a portion cut-away, of a generalized version of the yo-yo shown in FIG. 6.

FIG. 7 provides a perspective view of a generalized form of the yo-yo shown in FIG. 6, with portions not shown, and a portion cut-away to facilitate viewing of the yo-yo's tether engagement ribs 58. One can see that the gaps 80 and ribs 58 of the two side members are offset whereby the ribs of one side member are not directly opposite the ribs of the other side member.

When the ribs are offset, the straight line distance between any rib of one side member to the nearest rib of the other side member can no longer be measured in a direction parallel to the yo-yo's axis, but must be measured on a diagonal relative to said axis. As a result, the linear distance between indirectly opposing ribs is greater than when the ribs directly oppose each other. This increased distance functions in the same manner as if one were to significantly increase the string gap, with a concomitant reduction in the probability that any portion of the tether's strands will contact a rib 58. Furthermore, the offset locations of the ribs create a more streamlined flow profile of the air within the yo-yo's string gap, thereby theoretically reducing the turbulence in the string gap that could cause a strand of the tether to move toward and engage one of the ribs 58. As a result, when the ribs are offset, the yo-yo's tether engagement system is effectively less aggressive and allows the yo-yo to be smoother on the string whereby the chance for an inadvertent snagging of the tether on a rib 58 is decreased.

One should note in this embodiment that the same direction of relative rotation between the yo-yo's side members can cause the yo-yo's tether engagement system to go from an aggressive mode (gaps aligned), to a less aggressive mode (gaps offset) and then back to a more aggressive mode (gaps aligned again). In the embodiment shown, with eight evenly spaced gaps 80 in the ring of each side member, the above progression from aggressive, to less aggressive and then to more aggressive again only requires a forty-five degree relative rotation of the side members. The visual indication system makes it possible for a user to accomplish this without guesswork and to thereby significantly change the yo-yo's responsiveness with only slight relative rotations of the yo-yo's side members. In the embodiment shown, it only requires a 22.5 degree angular rotation of one side member relative to the other to go from a condition where the engagement members directly oppose each other to a position of maximum offset of the engagement members.

Also in this embodiment, while each side member is shown having eight visual indicators in the form of gaps 80, a fewer, or greater, number of visual indicators may be employed. Furthermore, while the visual indicators are shown as gaps in a separate ring member, other forms of visual indicators may be employed. The visual indicators may take the form of any type of indicia and be located in, or on, the rims of the side members, or even at other locations on each side member.

Figure 8:
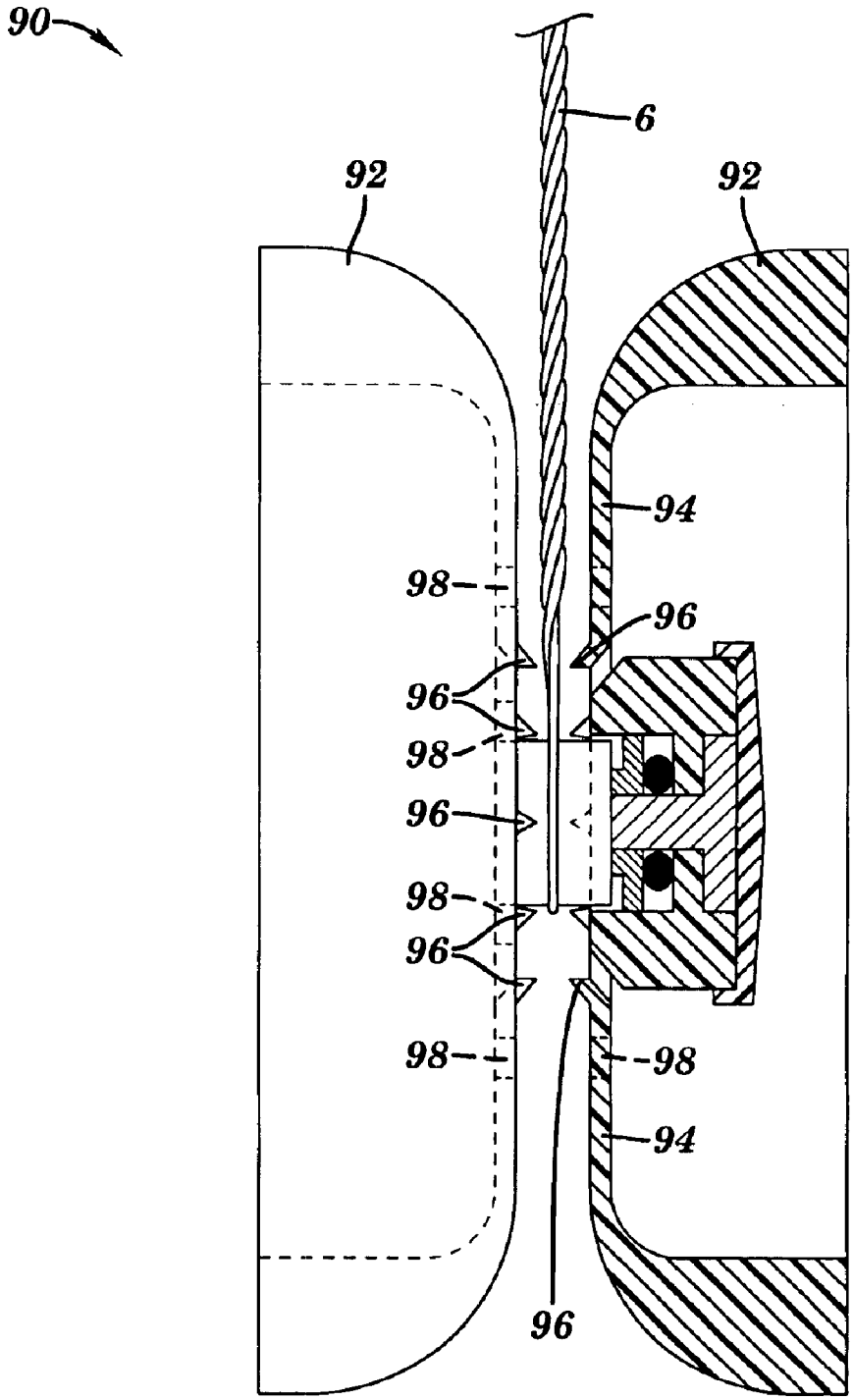
FIG. 8 is a front view, with a portion in cross-section, of a second embodiment of a yo-yo in accordance with the invention.
Figure 10:
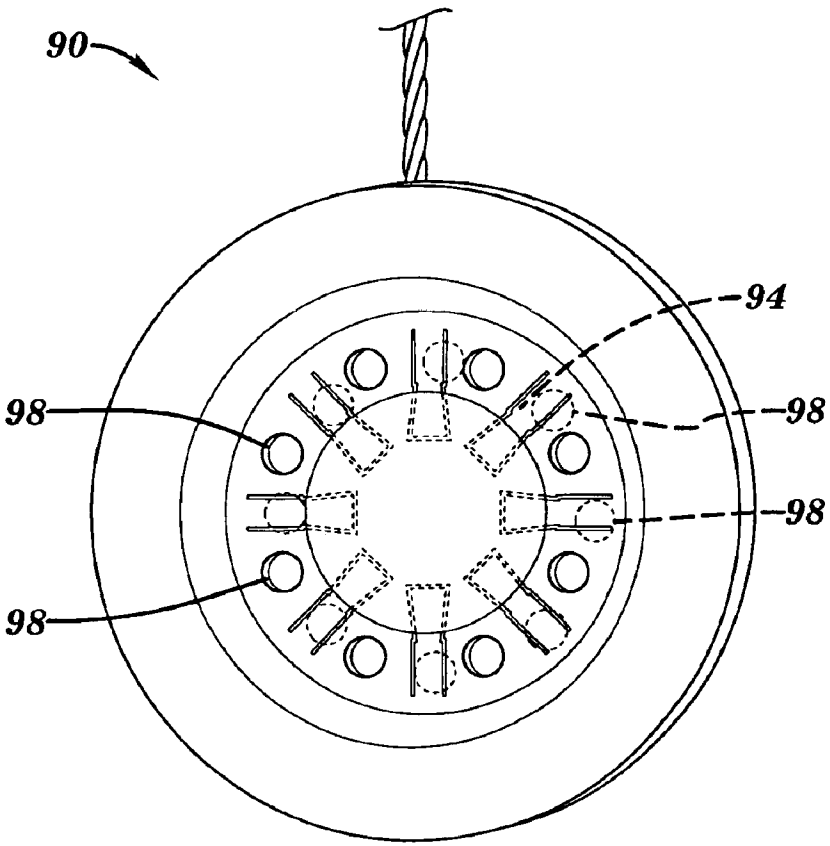
FIG. 10 is a perspective view of the yo-yo shown in FIG. 8 after one of the yo-yo's side members has been slightly rotated relative to the other of the yo-yo's side members.
Figure 9:
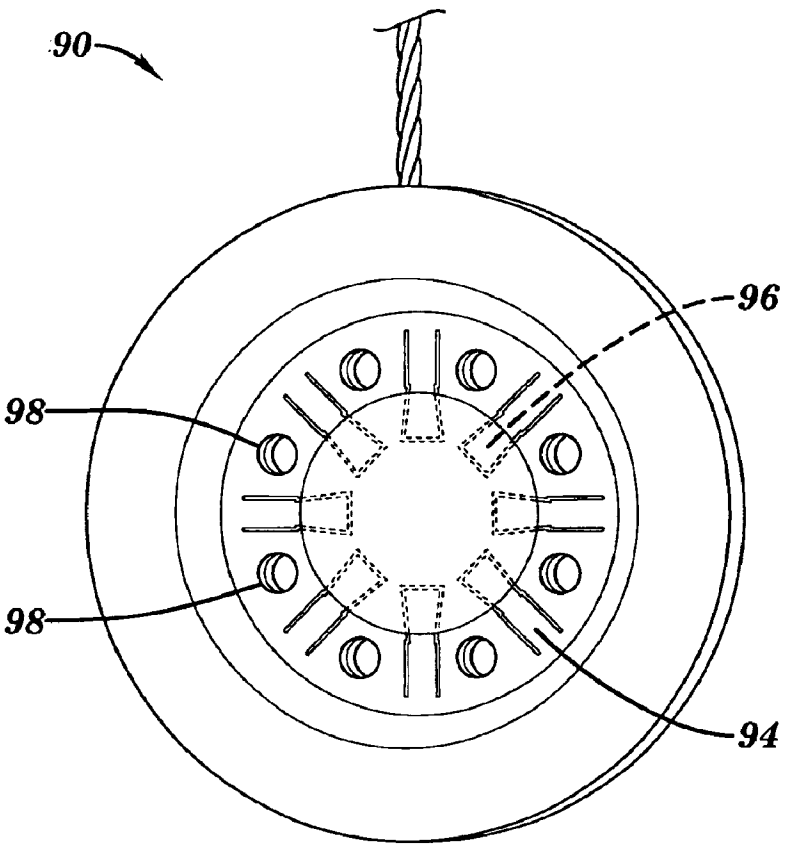
FIG. 9 is a perspective view of the yo-yo shown in FIG. 8.

FIGS. 8–10 provide views of a second embodiment of a yo-yo 90 in accordance with the invention. The yo-yo features adjustable responsiveness and a visible indication system that facilitates adjustment of the yo-yo's responsiveness and provides a user with an indication of the yo-yo's responsiveness setting.

FIG. 8 provides a front view of the yo-yo 90, with one of its two identical side members 92 shown in cross-section. Unlike yo-yo 1, the semi-flexible finger members 94 are not located on a separate part that is inserted into the side member, but are instead formed portions of the side members. Each side member preferably includes eight tether engagement members/ribs 96, with a rib located at the end of each finger member. A greater, or fewer, number of ribs and finger members may be employed. The yo-yo's axle structure is preferably the same as that used in the first embodiment and enables adjustment of the width of the yo-yo's string gap via relative rotation of the side members.

In this embodiment, the visual indicators of the visual indication system are in the form of a plurality of easily visible thru-holes 98 that extend completely through each side member. The thru-holes are situated in identical locations in both side members whereby both side members have the same registry between their associated thru-holes and tether engagement ribs 94. This registry enables the thru-holes of a side member to visually indicate to a user the position of the side member's ribs 94. While the embodiment shown includes eight thru-holes in each side member, a greater or fewer number of thru-holes may be employed. Also, while a round thru-hole 98 is shown located between each pair of finger members, other shapes and/or sizes of thru-holes may be employed and the thru-holes may be situated in other locations. Furthermore, while not preferred, the thru-holes can be replaced by indicia, with said indicia preferably located on, or proximate, the rim of each side member.

The yo-yo's side members 92 may be made of any rigid or semi-rigid material. Preferably, the side members are made of an opaque plastic material. All of a side member's thru-holes 98 are preferably located an equal distance from the side member's center and preferably have an identical size and shape.

When one aligns the thru-holes of one side member with those of the other side member, one automatically positions the ribs of one side member to directly face/oppose the ribs of the other side member. The result is the same registry of tether engagement members as is shown in FIG. 5 when the gaps 80 of the first embodiment are aligned. In such a position, the yo-yo's response system is in an aggressive mode in which the yo-yo's ability to return on command is favored.

FIG. 9 provides a perspective view of the yo-yo 90, when the thru-holes of both side members are in alignment. As can be seen in the figure, when the thru-holes are in alignment, one can look through a thru-hole of one side member and see a thru-hole of the other side member.

FIG. 10 provides a perspective view of yo-yo 90 when the thru-holes are in a non-aligned, offset position. In the figure, the thru-holes in the rearmost side member are shown in phantom. When set in this manner, the ribs of one side member will be offset from the ribs of the other side member, much the same as is shown in FIG. 7 when the gaps 80 of the first embodiment are non-aligned. When the yo-yo is set in this way, the yo-yo's response system is in a less aggressive mode that allows an experienced user to perform yo-yo tricks with less chance for an inadvertent return of the yo-yo.

It should be noted for this embodiment that when the thru-holes 98 are aligned, a user could look entirely through the yo-yo by looking through any of the thru-holes. This feature can facilitate a user's ability to adjust the yo-yo's responsiveness. For example, if a user desires the yo-yo setting to favor return on command, said user could hold the yo-yo up to a light and note whether light shines through the thru-holes, or is blocked. If the light is blocked (yo-yo is set per FIG. 10), the user could then rotate one side member relative to the other until light passes through the thru-holes (yo-yo is set per FIG. 9), indicating that the yo-yo's ribs 96 are in direct opposition.

It should be noted that the use of a visual indication system, as taught herein, may be employed with other types of yo-yos than the ones shown. For example, the system can facilitate tether engagement in yo-yos having other types of response systems, including a conventional starburst pattern of raised ribs. Furthermore, the system can even be used with yo-yos in which the side members are not normally relatively rotatable. In the latter case, the yo-yo would have to be disassembled and then reassembled with the side members in a different position relative to each other.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A yo-yo comprising:

first and second side members secured together in a spaced-apart relation by an axle structure;

a tether secured to a portion of said axle structure;

wherein each of said side members has a tether-facing surface;

a plurality of tether engagement members located on the tether facing surface of each of said side members, wherein when said yo-yo is spinning at the end of said tether, a user can cause said tether to snag at least one of said tether engagement members and thereby cause said tether to wind about said axle structure; and wherein each of said side members includes a visual indicator in registry with its tether engagement members, wherein said visual indicator functions to indicate to a user the position of the associated side member's tether engagement members, wherein said side members can be positioned whereby both of said visual indicators are capable of being viewed simultaneously from a point exterior to the yo-yo, and wherein the registry between each side member's visual indicator and its tether engagement members is substantially identical for both side members whereby when said visible indicator of one side member is in direct alignment with said visual indicator of the other side member, the tether engagement members of one side member will be located at a predetermined position relative to the tether engagement members of the other side member.

2. The yo-yo of claim 1 wherein the first and second side members are relatively rotatable so that by rotating one side member relative to the other side member, a user can cause the visual indicator of one side member to move from a position where it is aligned with the visual indicator of the other side member to a position where it is offset from the visual indicator of the other side member and wherein when said visual indicators are offset, the tether engagement members of one side member will be offset from the tether engagement members of the other side member.

3. The yo-yo of claim 2 wherein said axle structure includes an adjustment mechanism that enables a user to change a string gap dimension of said yo-yo and wherein said mechanism enables said first side member to be rotated relative to said second side member.

4. The yo-yo of claim 1 wherein each side member includes an interior area in which is located the associated side member's visual indicator and wherein each of said side members includes at least a portion through which the side member's visual indicator may be viewed.

5. The yo-yo of claim 4 wherein each of said side members is made of a non-opaque material.

6. The yo-yo of claim 5 wherein each of said side members is made of a clear plastic material.

7. The yo-yo of claim 1 wherein each side member includes a plurality of visual indicators in registry with the associated side member's tether engagement members.

8. The yo-yo of claim 7 wherein a plurality of said visual indicators are substantially identical.

9. The yo-yo of claim 7 wherein each side member's tether engagement members are connected to a common ring structure that includes a plurality of gaps, wherein each side member is made of a material through which a user located at a point exterior to the yo-yo can see at least one of said gaps and wherein said gaps function as said visual indicators.

10. The yo-yo of claim 1 wherein each of said side members includes an outer side surface that faces away from said tether, and wherein said visual indicator is viewable when a user looks at said outer side surface.

11. The yo-yo of claim 1 wherein each of said side members includes a rim portion having a peripheral surface, and wherein said visual indicator is viewable when a user looks at said peripheral surface of said rim portion.

12. The yo-yo of claim 1 wherein the visual indicator of each side member is in the form of a thru-hole located radially outwardly from a center axis of the associated side member.

13. The yo-yo of claim 12 wherein when the thru-hole of one side member is aligned with the thru-hole of the other side member, one can look through either of said thru-holes and look completely through said yo-yo.

14. The yo-yo of claim 1 wherein each side member includes a plurality of visual indicators in registry with its tether engagement members and wherein said visual indicators are in the form of thru-holes.

15. The yo-yo of claim 1 wherein the tether engagement members are in the form of raised ribs.

16. The yo-yo of claim 1 wherein each side member's tether engagement members are located in a starburst-shaped pattern.

17. A yo-yo comprising:

first and second side members secured together in a spaced-apart and relatively rotatable relation by an axle structure;

a tether secured to a portion of said axle structure;

wherein each of said side members has a tether-facing surface;

a tether engagement member located on the tether facing surface of each of said side members, wherein when said yo-yo is spinning at the end of said tether, a user can cause said tether to snag at least one of said tether engagement members and thereby cause said tether to wind about said axle structure; and wherein each of said side members includes at least one visual indicator in registry with said tether engagement member of the associated side member, wherein each of said visual indicators functions to provide an indication to a user of the location of the associated side member's tether engagement member, wherein the registry between each side member's visual indicator and its tether engagement member is substantially identical for both side members, wherein said side members can be rotated whereby a user, located at a point exterior to the yo-yo, can position the yo-yo's visual indicators to be in direct alignment so that said tether engagement member of one side member will be located at a predetermined position relative to said tether engagement member of the other side member.

18. A yo-yo comprising:

first and second relatively rotatable side members connected together by an axle structure;

a tether attached to said axle structure;

wherein each of said side members has a tether-facing surface that includes a plurality of tether engagement members; and wherein each of said side members further includes a plurality of substantially identical visual indicators in registry with its tether engagement members, wherein said visual indicators are viewable from a point exterior to the yo-yo, wherein said side members can be positioned whereby a user can view, at the same time, at least one visual indicator of the first side member and at least one visual indicator of the second side member, and wherein the registry between each side member's visual indicators and its engagement members is substantially identical for both side members whereby a user can affect the yo-yo's ability to return on command in a predetermined manner by locating the visual indicators of one side member in a predetermined position relative to the visual indicators of the other side member.

19. The yo-yo of claim 18, wherein:

if the visual indicators of the first side member are not aligned with the visual indicators of the second side member, a user can increase the yo-yo's tendency to return on command by rotating the first side member relative to the second side member in a first direction until at least one visual indicator of the first side member is aligned with at least one visual indicator of the second side member; and if the visual indicators of the first side member are aligned with the visual indicators of the second side member, a user can lessen the yo-yo's tendency to return on command by rotating the first side member relative to the second side member in said first direction until the visual indicators of the two side members are no longer aligned.

20. A method of adjusting the response system of a yo-yo, wherein said yo-yo comprises first and second relatively rotatable side members connected together by an axle structure to which a tether may be attached, wherein each of said side members has an inwardly-facing surface that includes a plurality of tether engagement members, wherein each of said side members further includes a plurality of substantially identical visual indicators in registry with its tether engagement members, wherein said visual indicators are viewable from a point exterior to the yo-yo, wherein said side members can be positioned whereby a user can view, at the same time, at least one visual indicator of the first side member and at least one visual indicator of the second side member, and wherein the registry between each side member's visual indicators and its engagement members is substantially identical for both side members, said method comprising:

holding the first side member in one hand while holding the second side member in the other hand;

wherein if the visual indicators of the first side member are not aligned with the visual indicators of the second side member and one wish to increase the yo-yo's tendency to return on command, one then rotates the first side member relative to the second side member in a first direction until said at least on visual indicator of the first side member is aligned with at least one visual indicator of the second side member; and wherein if the visual indicators of the first side member are aligned with the visual indicators of the second side member and one wishes to lessen the yo-yo's tendency to return on command, one can then rotate the first side member relative to the second side member in said first direction until the visual indicators of the two side members are no longer aligned.

* * * * *